US006957469B2

(12) United States Patent
Davies

(10) Patent No.: US 6,957,469 B2
(45) Date of Patent: Oct. 25, 2005

(54) TOOTHBRUSH

(75) Inventor: Richard Huw Davies, Gaggiano (IT)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 10/385,815

(22) Filed: Mar. 11, 2003

(65) Prior Publication Data

US 2003/0208865 A1 Nov. 13, 2003

(30) Foreign Application Priority Data

Mar. 14, 2002 (EP) ..... 02251831

(51) Int. Cl.[7] ..... A46B 9/04
(52) U.S. Cl. ..... 15/167.1; 15/110; 15/DIG. 5
(58) Field of Search ..... 15/110, 117, 167.1, 15/DIG. 5; D4/104

(56) References Cited

U.S. PATENT DOCUMENTS

| | | | | | |
|---|---|---|---|---|---|
| 1,191,556 | A | | 7/1916 | Blake | 15/117 |
| 1,452,108 | A | * | 4/1923 | Carter | 15/167.1 |
| 1,770,195 | A | * | 7/1930 | Burlew | 15/167.1 |
| 2,209,173 | A | * | 7/1940 | Russell | 15/167.1 |
| D163,707 | S | * | 6/1951 | Pifer | D4/104 |
| 3,103,679 | A | | 9/1963 | Clemens | |
| 3,295,156 | A | | 1/1967 | Brant | 15/167.1 |
| 5,345,647 | A | * | 9/1994 | Liu | 15/207.2 |
| 5,392,483 | A | | 2/1995 | Heinzelman et al. | 15/167.1 |
| 5,544,383 | A | * | 8/1996 | Gamble | 15/106 |
| 5,628,082 | A | | 5/1997 | Moskovich | |
| 5,802,656 | A | | 9/1998 | Dawson et al. | 15/110 |
| 6,041,467 | A | | 3/2000 | Roberts et al. | |
| 6,134,737 | A | | 10/2000 | Remme | 15/110 |
| 6,219,875 | B1 | | 4/2001 | Medynski et al. | |
| 6,311,360 | B1 | | 11/2001 | Lanvers | 15/191.1 |
| 2002/0004964 | A1 | | 1/2002 | Luchino et al. | 15/167.1 |

FOREIGN PATENT DOCUMENTS

| | | | |
|---|---|---|---|
| DE | 41 01 366 | | 1/1991 |
| DE | 4420911 | | 3/1995 |
| EP | 0 449 655 | | 3/1991 |
| EP | 0 888 072 | | 6/1996 |
| FR | 536161 | | 4/1922 |
| FR | 1100290 | | 9/1955 |
| JP | 2000-175743 | * | 6/2000 |
| JP | 2001-286341 | * | 10/2001 |
| WO | 99/01054 | | 1/1999 |
| WO | 01/12013 | | 2/2001 |

* cited by examiner

*Primary Examiner*—Mark Spisich

(57) ABSTRACT

A toothbrush comprises a handle and a head for improved cleaning to the interdental regions of the teeth, the head comprising a linear arrangement of bristles transverse to the general longitudinal axis of the brush and extending along a length equal to or greater than a third of the width of the toothbrush head at the location of the arrangement, characterised in that a portion of the bristles at either end of the arrangement are angled away from the vertical such that the arrangement presents a fan-shaped transverse brushing array.

7 Claims, 2 Drawing Sheets

TOOTHBRUSH

BACKGROUND AND SUMMARY

1. Field of the Invention

The present invention relates to a toothbrush comprising a handle and a head for improved cleaning to the interdental regions of the teeth, said head comprising a linear arrangement of bristles transverse to the general longitudinal axis of the brush and extending along a length equal to or greater than a third of the width of the toothbrush head at the location of the arrangement.

2. The Related Art

U.S. Pat. No. 1,191,556 (Blake) details a toothbrush consisting of the usual tuft bristle formation interspersed with flexible blades.

WO 99/01054 outlines a toothbrush with flexible fin structures that aid in the cleaning process by penetrating the interproximal region of teeth.

U.S. Pat. No. 5,392,483 details a patent application with normal bristle tufts in which the terminal tufts of the toothbrush are inclined away from each other.

U.S. Pat. No. 3,295,156 discloses individual tufts fan but not a confluent linear array of bristles.

SUMMARY OF THE INVENTION

According to the present invention, there is provided a toothbrush comprising a handle and a head for improved cleaning to the interdental regions of the teeth, said head comprising a linear arrangement of bristles transverse to the general longitudinal axis of the brush and extending along a length equal to or greater than a third of the width of the toothbrush head at the location of the arrangement, characterised in that a portion of the bristles at either end of the arrangement are angled away from the vertical such that the arrangement presents a fan-shaped transverse brushing array.

DETAILED DESCRIPTION OF INVENTION

Preferably the linear arrangement presents a fan-shaped brushing array which is comprised of a row of individually fixed bristle tufts.

The bristle tufts making up the fan-shaped brushing array may suitably be fixed to the brush head by so called anchor technology whereby the bristle tufts are bent in half by a strip of metal which is pressed into the wall surrounding the tuft hole.

Alternatively the tufts may be fixed to the brush head by in-mould welding. This is a newer technique which involves the moulding of the brush head around a fixed bristle tuft.

The bristle tuft holes used to fix the bristle tufts to the head are suitably dimensioned to provide for the formation of a fan-shaped brushing array. Preferably, this means that the tuft holes are located close to one another and in a linear arrangement. More preferably, the bristle tuft holes are square or rectangular in shape. Where they are rectangular they consist of a pair of opposing long wall faces and a pair of opposing short wall faces with the array of holes arranged such that the long wall faces are substantially aligned. Preferably the long faces are greater in length than the short faces, more preferably, the long faces are from about 1.01 to about 1.2 times the length of the short faces. Preferably, the short faces are aligned with the general longitudinal axis of the brush head. In this way the confluence of the individual bristle tufts in the fan-shaped brushing arrays can be maximised.

In a more preferred embodiment the holes at the two edges of the transverse linear arrangement when viewed from above are tapered such that the edge of the fan presents a softened wall. This reduces the hard nature of bristle tufts which protrude beyond the normal brushing surface.

The linear arrangement brushing elements according to the invention are fan-shaped. This means that viewed from the tip end of the brush down towards the handle the transverse array presents a wall of bristle tufts which is narrower at the bottom than at the top, i.e. the bristle brushing area is greater than the area of the tufts holes and extends laterally beyond the end holes.

Preferably, a portion of the bristles within the fan-shaped brushing array are angled with respect to the vertical. Preferably, these bristles area angled away from the centre line along the longitudinal axis of the brush head. Preferably, the fan-shaped brushing array is dimensioned such that the ends of the fan-shaped array are angled at from about 0.5° to about 30° from one another, more preferably from about 5° to about 25° and especially from about 13° to about 22°.

In a preferred embodiment the bristles at the ends of the linear arrangement which are angled comprise a portion amounting to from about 0.5 to about 30% of the bristles within the linear fan-shaped array. More preferably, from about 3 to about 25% and especially from about 10 to about 20% of the bristles in the fan-shaped linear arrangement are angled.

In another preferred embodiment the brushing surface of the fan-shaped array is arcuate when viewed from the tip of the brush down towards the handle. Preferably, the brushing surface of the fan-shaped array is arcuate in the sense that it extends further from the brush head in the middle of the array and gradually less so at the ends.

In a preferred embodiment the brush according to the invention comprises further bristles which may or may not be arranged in bristle tufts as is the usual fashion in toothbrush technology. These 'conventional' bristles provide additional cleaning to the teeth in use. Typically these conventional bristles extend an average length l from the brush head to a tip. Preferably, the bristles making up the fan-shaped array extend a length ranging from about 1 to about 1.5 l, more preferably from about 1.05 to about 1.4 l and especially preferably from about 1.1 to about 1.35 l. This relationship between the lengths of the bristles in the fan-shaped array and other, conventional bristles on the brush head provides a synergistic cleaning of the teeth during use. The fan-shaped arrays excise the debris from the interdental regions and the conventional bristles remove the debris from the dentition such that it can be removed from the oral cavity during expectoration.

In a further preferred embodiment the bristles in the fan-shaped array are more flexible than those in the conventional tufts. This flexibility is not just due to the longer length but also because of the more flexible nature of the materials used. It may also be due to the reduced diameter of the bristle filaments in the fan-shaped array. Preferably the diameter of the bristle in the fan-shaped array ranges from about 0.75 to about 0.99 that of the bristles in the conventional bristles, more preferably from about 0.85 to about 0.95 and especially preferably from about 0.9 to about 0.95 that of the conventional bristles.

In a further preferred embodiment the fan-shaped array is supported on the brush head by a supporting boot. Such supporting boots are known in the prior art, for example in EP 0 888 072 (M+C Schiffer).

In a preferred embodiment such supporting boots compress the fan-shaped arrays such that the bristle tufts present a more concentrated brushing surface without compromising the fan-shaped arrangement. More preferably, the compression occurs in an axis aligned to the general longitudinal axis of the brush head. In the alternative the compression may also occur in a direction substantially transverse the general longitudinal axis of the brush head. In this way the compression slightly reduces the angle of the angled bristles at the edges of the fan-shaped array but this also assist in concentrating the bristles at their brushing ends.

In a more preferred embodiment the boots have an end on profile substantially similar to the profile of the fan-shaped array also in end on view. In other words it is preferred that the profile of the boots is also arcuate being higher in the middle than at the edges.

It is also preferred that each individual boot encompasses an entire fan-shaped array so that the fan shaped array does not lose its confluent bristle presentation.

The boots are typically moulded out of an elastomeric material which provides some elasticity to the supporting role of the boot. Suitable elastomers are well known in the art to the person skilled in plastics manufacture.

In an alternatively preferred embodiment the brush according to the invention comprises a rubbery tooth pick device for cleaning further the interdental regions of the teeth. While tooth picks are known in brushes they are not known in combination with the fan-shaped bristle arrays as defined herein. We have surprisingly found that the cleaning efficacy of the toothpicks is markedly improved with the combination of picks and fan-shaped arrays since the fan-shaped arrays loosen the hard to remove material stuck between the teeth and the picks are then able to remove said matter more easily.

Preferably, said pick is a flattened structure with flattened faces lying transverse the general longitudinal axis of the brush head. Accordingly, the pick is thus substantially bendable in a direction of motion along the general longitudinal axis of the brush head and less so in a direction transverse the general longitudinal axis of the brush head. This means that the pick has less resilience and thus greater cleaning efficacy when bent in a direction transverse the longitudinal axis of the brush head than when bent in a direction along said axis. This allows the picks to get between the teeth and prise out the hard to remove material when the brushing direction is up and down (in a direction transverse the general longitudinal axis of the brush head) rather than side to side. In a side to side motion the pick provides a tooth polishing effect as it rubs over the surface of the tooth.

In a preferred embodiment the pick is ellipsoidal in shape towards the tip end of the pick. Said ellipsoidal shape provides the maximum cleaning efficacy without harming the gums. A pointed shape would harm the gums and a fully rounded shape would not be able to focus the pressure in the tip sufficiently to remove fastened debris from between the teeth.

Said picks are suitably made from an elastomeric material similar to the material of the boots and these are commercially available in many different forms which are well known to the man skilled in the art. Accordingly, the behaviour of the picks can be modified by the man skilled in the art by careful consideration of the physical properties of the elastomeric materials.

The foregoing description and examples illustrate selected embodiments of the present invention. In light thereof variations and modifications will be suggested to one skilled in the art, all of which are within the spirit and purview of this invention.

BRIEF DESCRIPTION OF THE DRAWINGS

Further objects, features and advantages of the present invention will become more evident through consideration of the following drawings in which.

DETAILED DESCRIPTION OF DRAWINGS

Figure 1:
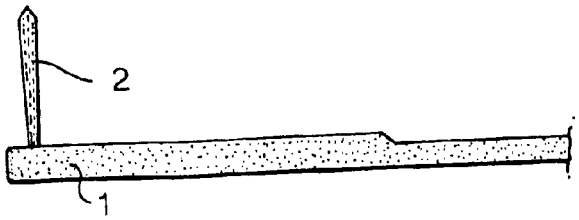
FIG. 1 is a side elevational view of part of a brush head according to the invention.

In more detail, FIG. 1 discloses a brush head (1) comprising a fan-shaped brushing array (2). In this view the fan-shaped array (2) cannot be perceived as a fan-shaped array since it is transversely located on the brush head and is seen end on. The figure only shows the fan-shaped array and not any of the other features of the brush head for the sake of clarity. Other features may also be present as described herein without affecting the nature of the fan-shaped array.

Figure 2:
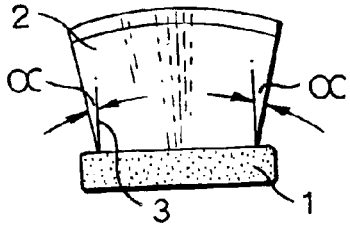
FIG. 2 is an end on view of the same brush head.

FIG. 2 discloses the brush head according to FIG. 1. Shown is a brush head (1) and a fan-shaped array (2). The bristles at the edges of the fan-shaped array are angled away from the vertical by $\alpha°$. The bristles at the centre of the fan-shaped array are substantially vertical with respect to the brush head. Again, the figure only shows the fan-shaped array and not any of the other features of the brush head for the sake of clarity. Other features may also be present as described herein without affecting the nature of the fan-shaped array.

Figure 3:
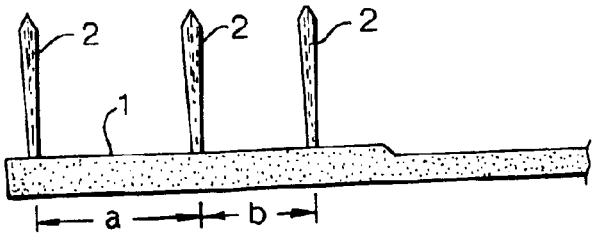
FIG. 3 is a side elevational view of part of a brush head according to the invention.

FIG. 3 is a brush head comprising three fan-shaped arrays (2). Starting from the tip end of the brush head the first fan-shaped array is a distance a from the second fan-shaped array. The second array is located at a distance b from the third array. Distance b is typically from 0.5 to 1.1 times a, preferably from 0.6 to 0.9 and especially preferably from 0.7 to 0.8 times a. These values are applicable in any embodiment of the invention comprising three fan-shaped arrays. Once again the figure only shows the fan-shaped arrays for the sake of clarity.

Figure 4:
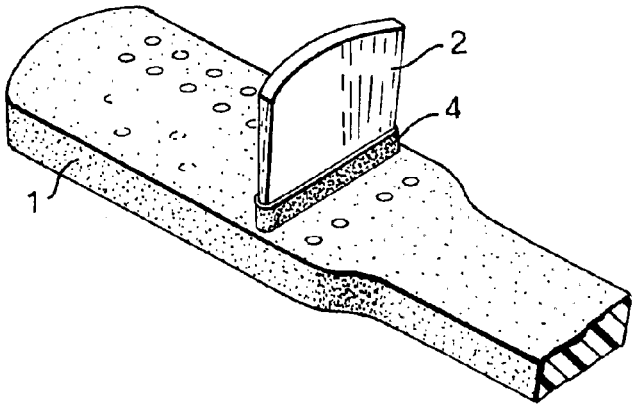
FIG. 4 is a perspective view of part of a brush head according to the invention.

FIG. 4 is a perspective view of a brush according to the invention. Shown is a fan-shaped array (2) which is supported by a supporting boot (4). Said boot extends from the brush head up to from 5 to 30% of the full extent of the average bristle height in the array. Preferably, it extends to from 10 to 25% the height. These values being applicable for any brush according to the invention which comprises supporting boots. Once again the figure only shows the fan-shaped array in a boot for the sake of clarity.

Figure 5:
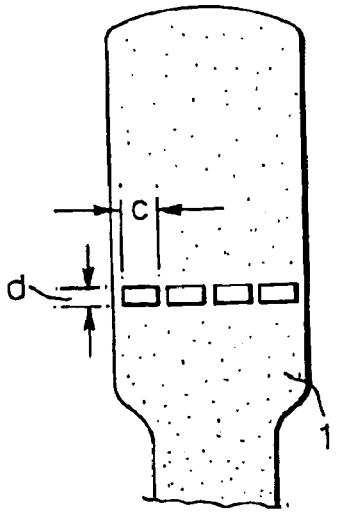
FIG. 5 is a plan view of part of a brush head according to the invention.
Figure 6:
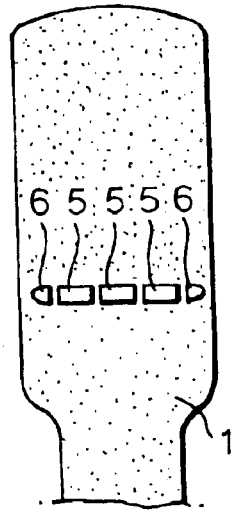
FIG. 6 is a plan view of part of a brush head according to the invention.

FIG. 5 shows a brush head comprising a row of tuft holes which are capable of housing a fan-shaped array. Shown are four bristle tuft holes (5) which have a length c and a width d which define a rectangular FIG. 6 shows a brush head similar to that in FIG. 5 but comprising a pair of lateral tufts holes (6) which are tapered towards the edge of the brush head.

Figure 7:
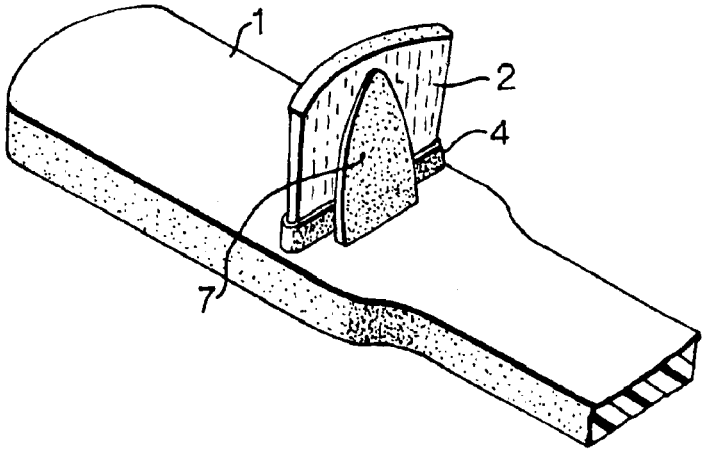
FIG. 7 shows part of a brush head in perspective view.

FIG. 7 discloses a brush head comprising a fan-shaped array (2) and a tooth cleaning pick (7). Said pick (7) is ellipsoidal in shape and flattened in a direction substantially along the general longitudinal axis of the brush head.

Figure 8:
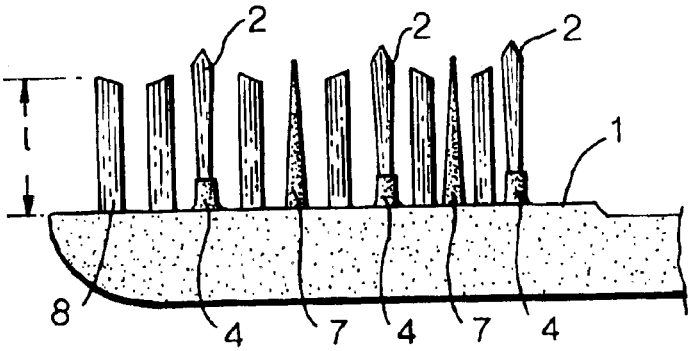
FIG. 8 shows a brush head in elevational view.

FIG. 8 discloses an elevational view of a toothbrush according to the invention. Shown are a brush head comprising three longitudinally spaced fan-shaped arrays (2), three longitudinally spaced picks (7) and conventional bristle tufts (8) there between. The conventional bristle tufts extend a length l from the brush head and the fan-shaped arrays extend a distance greater than l from the brush head. The picks are located between said fan-shaped arrays and the latter are disposed within supporting boots (4). The bristles making up the fan-shaped arrays do not extend longitudinally beyond the supporting boot's perimeter contour.

What is claimed is:

1. A toothbrush comprising a handle and a head for improved cleaning to the interdental regions of the teeth, said head comprising a linear arrangement of bristles placed on only one face of said brush head and positioned transverse to the general longitudinal axis of the brush and extending along a length equal to or greater than a third of the width of the toothbrush head at the location of the arrangement, characterized in that a portion of the bristles at either end of the arrangement are angled away from the vertical such that the arrangement presents a fan-shaped transverse brushing array, said head containing additional bristles placed only on said one face and spaced from said fan-shaped transverse brushing array, said bristles of said fan-shaped array extending farther from said brush head than said additional bristles extend from said brush head and wherein said bristles of said fan-shaped array defining a continuous wall of bristles with an uninterupted arcuate brushing edge along the length of the array.

2. Toothbrush according to claim 1, wherein the linear arrangement comprises a row of individually fixed bristle tufts.

3. Toothbrush according to claim 1, wherein the portion of bristles at either end of the linear arrangement are angled at from about 0.5° to about 20°.

4. Toothbrush according to claim 1, wherein the angled portion of bristles at either end of the linear arrangement constitutes from about 0.5% to about 30% of the total number of bristles in the arrangement.

5. Toothbrush according to claim 1, wherein the linear arrangement is supported by a supporting boot.

6. Toothbrush according to claim 5, wherein the boot compresses the linear arrangement in a direction transverse to the general axis of the linear arrangement.

7. Toothbrush according to claim 1, wherein the brush also comprises rubbery picks.

* * * * *